US005604078A

United States Patent [19]

Campbell et al.

[11] Patent Number: 5,604,078

[45] Date of Patent: Feb. 18, 1997

[54] RECEIVING ELEMENT FOR USE IN THERMAL DYE TRANSFER

[75] Inventors: Bruce C. Campbell, Rochester; Daniel J. Harrison, Pittsford, both of N.Y.

[73] Assignee: Eastman Kodak Company, Rochester, N.Y.

[21] Appl. No.: 568,913

[22] Filed: Dec. 7, 1995

[51] Int. Cl.[6] ..... B41M 5/035

[52] U.S. Cl. ..... 430/201; 430/200; 503/227; 428/195; 428/913; 428/914; 162/168.1; 162/164.2; 162/164.1; 162/231; 428/318.4; 428/481

[58] Field of Search ..... 428/195, 315.5, 428/318.4, 318.8, 910, 913, 914, 200, 211, 479.3, 481, 485, 507; 503/227; 430/200, 201; 162/168.1, 164.7, 164.1, 231

[56] References Cited

U.S. PATENT DOCUMENTS

| | | | |
|---|---|---|---|
| 3,616,178 | 10/1971 | Gurin et al. | 428/343 |
| 4,137,046 | 1/1979 | Koike et al. | 162/168.2 |
| 5,098,882 | 3/1992 | Teraji et al. | 503/209 |
| 5,242,739 | 9/1993 | Kronzer et al. | 428/200 |
| 5,244,861 | 9/1993 | Campbell et al. | 503/227 |
| 5,250,496 | 10/1993 | Warner et al. | 503/227 |
| 5,391,473 | 2/1995 | Lacz et al. | 430/538 |

OTHER PUBLICATIONS

Kato et al. Abstract of JP 03–146798 (Jun. 1991).

*Primary Examiner*—Janet C. Baxter
*Assistant Examiner*—Martin J. Angeranndt
*Attorney, Agent, or Firm*—Harold E. Cole

[57] ABSTRACT

Thermal dye transfer receiving elements are disclosed comprising a base having thereon a dye image-receiving layer, the base comprising a composite film laminated to a support, the dye image-receiving layer being on the composite film side of the base. The composite film comprises a microvoided thermoplastic core layer and at least one substantially void-free thermoplastic surface (skin) layer having a thickness of about 3 to about 6 μm, and the support comprising a latex-impregnated paper.

17 Claims, No Drawings

RECEIVING ELEMENT FOR USE IN THERMAL DYE TRANSFER

This invention relates to dye-receiving elements used in thermal dye transfer, and more particularly to receiving elements containing microvoided composite films.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out .are contained in U.S. Pat. No. 4,621,271, the disclosure of which is hereby incorporated by reference.

Dye-receiving elements used in thermal dye transfer generally comprise a polymeric dye image-receiving layer coated on a base or support. Transport through the thermal printer is very dependent on the base properties. For acceptable performance, the dye-receiving element must have low curl under a wide variety of environmental conditions, conditions at which the printer will be operating. From an aesthetics standpoint, it is also desirable for the dye-receiving element to exhibit low curl under the wide variety of environmental conditions at which the print will be displayed or kept.

U.S. Pat. No. 5,244,861 describes a dye-receiving element for thermal dye transfer comprising a base having thereon a dye image-receiving layer, wherein the base comprises a composite film laminated to a cellulosic paper support, the dye image-receiving layer being on the composite film side of the base, and the composite film comprising a microvoided thermoplastic core layer having a stratum of voids therein and at least one substantially void-free thermoplastic surface (skin) layer. This dye-receiving element exhibits low curl and excellent printer performance at typical ambient conditions.

There is a problem with this receiver under extreme environmental humidity conditions, however, when significant curl can be observed.

It is an object of this invention to provide a microvoided receiver for thermal dye transfer printing which has improved curl resistance under extreme environmental humidity conditions.

These and other objects are accomplished in accordance with the invention, which relates to a dye-receiving element for thermal dye transfer comprising a base having thereon a dye image-receiving layer, the base comprising a composite film laminated to a support, the dye image-receiving layer being on the composite film side of the base, the composite film comprising a microvoided thermoplastic core layer having a stratum of voids therein and at least one substantially void-free thermoplastic surface (skin) layer having a thickness of about 3 to about 6 μm, and the support comprising a latex-impregnated paper.

For example, the support can be a water leaf sheet of wood pulp fibers or alpha pulp fibers impregnated with a reactive acrylic polymer latex such as Rhoplex B-15® (Rohm and Haas Co., Philadelphia, Pa.). However, other latices can be used such as a polyacrylate, e.g., Hycar® 26083, 26084, 26120, 26104, 26106, 26322, (B. F. Goodrich Co, Cleveland, Ohio); Rhoplex® HA-8, HA-12, NW-1715 (Rohm and Haas Co., Philadelphia, Pa.); Carboset® XL-52 (B. F. Goodrich Co, Cleveland, Ohio); a styrene-butadiene copolymer such as Butofan® (BASF Corp. Sarnia, Ontario, Canada); DL-219 and DL-283 (Dow Chemical Co, Midland, Mich.); an ethylene-vinyl acetate copolymer, such as Dur-O-Set® E-666, E-646, E-669 (National Starch and Chemical Co., Bridgewater, N.J.); a nitrile rubber, such as Hycar® 1572, 1577, 1570x55 (B. F. Goodrich Co, Cleveland, Ohio); poly(vinyl chloride) such as Geon 552® (B. F. Goodrich Co, Cleveland, Ohio); poly(vinyl acetate) such as Vinac XX-210® (Air Products and Chemicals Inc. Napierville, Ill.); or an ethylene-acrylate copolymer such as Michem® Prime 4990 (Michelman, Inc., Cincinnati, Ohio) or Adcote® 56220 (Morton Thiokol, Inc., Chicago, Ill.).

In a preferred embodiment of the invention, the impregnated paper contains about 18 parts impregnating solids per 100 parts fiber by weight. In another preferred embodiment, the impregnated paper has a basis weight of about 58 g/m$^2$ on a dry weight basis. The impregnating dispersion can also contain clay and a delustrant such as titanium dioxide. Typical amounts of these two materials are 16 parts and 4 parts, respectively, per 100 parts of polymer on a dry weight basis. An especially preferred base sheet has a basis weight of 50 g/m$^2$ before impregnation. For further details of latex-impregnated papers, reference is made to U.S. Pat. No. 5,242,739, the disclosure of which is hereby incorporated by reference. Examples of latex-impregnated papers disclosed within U.S. Pat. No. 5,242,739 include papers impregnated with 18 to 40 parts per 100 parts fiber by weight.

Due to their relatively low cost and good appearance, composite films are generally used and referred to in the trade as "packaging films." The low specific gravity of microvoided packaging films (preferably between 0.3–0.7 g/cm$^3$) produces dye-receivers that are very conformable and results in low mottle-index values of thermal prints. These microvoided packaging films also are very insulating and produce dye-receiver prints of high dye density at low energy levels. The nonvoided skin produces receivers of high gloss and helps to promote good contact between the dye-receiving layer and the dye-donor film. This also enhances print uniformity and efficient dye transfer.

Microvoided composite packaging films are conveniently manufactured by coextrusion of the core and surface layers, with subsequent biaxial orientation, whereby voids are formed around void-initiating material contained in the core layer. Such composite films are disclosed in, for example, U.S. Pat. No. 4,377,616, the disclosure of which is incorporated by reference.

The core of the composite film should be from 15 to 95% of the total thickness of the film, preferably from 30 to 85% of the total thickness. The nonvoided skin(s) should thus be from 5 to 85% of the film, preferably from 15 to 70% of the thickness. The density (specific gravity) of the composite film should be between 0.2 and 1.0 g/cm$^3$, preferably between 0.3 and 0.7 g/cm$^3$. As the core thickness becomes less than 30% or as the specific gravity is increased above 0.7 g/cm$^3$, the composite film starts to lose useful compressibility and thermal insulating properties. As the core thickness is increased above 85% or as the specific gravity becomes less than 0.3 g/cm$^3$, the composite film becomes less manufacturable due to a drop in tensile strength and it becomes more susceptible to physical damage. The total thickness of the composite film can range from 20 to 150 μm, preferably from 30 to 70 μm. Below 30 μm, the microvoided films may not be thick enough to minimize any inherent non-planarity in the support and would be more difficult to manufacture. At thicknesses higher than 70 μm, little improvement in either print uniformity or thermal efficiency are seen, and so there is little justification for the further increase in cost for extra materials.

"Void" is used herein to mean devoid of added solid and liquid matter, although it is likely the "voids" contain gas. The void-initiating particles which remain in the finished packaging film core should be from 0.1 to 10 μm in diameter, preferably round in shape, to produce voids of the desired shape and size. The size of the void is also dependent on the degree of orientation in the machine and transverse directions. Ideally, the void would assume a shape which is defined by two opposed and edge contacting concave disks. In other words, the voids tend to have a lens-like or biconvex shape. The voids are oriented so that the two major dimensions are aligned with the machine and transverse directions of the film. The Z-direction axis is a minor dimension and is roughly the size of the cross diameter of the voiding particle. The voids generally tend to be closed cells, and thus there is virtually no path open from one side of the voided core to the other side through which gas or liquid can traverse.

The void-initiating material may be selected from a variety of materials, and should be present in an amount of about 5–50% by weight based on the weight of the core matrix polymer. Preferably, the void-initiating material comprises a polymeric material. When a polymeric material is used, it may be a polymer that can be melt-mixed with the polymer from which the core matrix is made and be able to form dispersed spherical particles as the solution is cooled down. Examples of this would include nylon dispersed in polypropylene, poly(butylene terephthalate) in polypropylene, or polypropylene dispersed in poly(ethylene terephthalate). If the polymer is preshaped and blended into the matrix polymer, the important characteristics are the size and shape of the particles. Spheres are preferred and they can be hollow or solid. These spheres may be made from crosslinked polymers which are members selected from the group consisting of an alkenylaromatic compound of general formula $Ar—C(R)=CH_2$, wherein Ar represents an aromatic hydrocarbon radical, or an aromatic halohydrocarbon radical of the benzene series and R is hydrogen or the methyl radical; acrylate-type monomers include monomers of the formula $CH_2=C(R')—C(O)(OR)$ wherein R is selected from the group consisting of hydrogen and an alkyl radical containing from about 1 to 12 carbon atoms and R' is selected from the group consisting of hydrogen and methyl; copolymers of vinyl chloride and vinylidene chloride, acrylonitrile and vinyl chloride, vinyl bromide, vinyl esters having formula $CH_2=CH(O)COR$, wherein R is an alkyl radical containing from 2 to 18 carbon atoms; acrylic acid, methacrylic acid, itaconic acid, citraconic acid, maleic acid, fumaric acid, oleic acid, vinylbenzoic acid; the synthetic polyester resins which are prepared by reacting terephthalic acid and dialkyl terephthalics or ester-forming derivatives thereof, with a glycol of the series $HO(CH_2)_nOH$ wherein n is a whole number within the range of 2–10 and having reactive olefinic linkages within the polymer molecule, the above described polyesters which include copolymerized therein up to 20 percent by weight of a second acid or ester thereof having reactive olefinic unsaturation and mixtures thereof, and a cross-linking agent selected from the group consisting of divinylbenzene, diethylene glycol dimethacrylate, diallyl fumarate, diallyl phthalate and mixtures thereof.

Examples of typical monomers for making the crosslinked polymer include styrene, butyl acrylate, acrylamide, acrylonitrile, methyl methacrylate, ethylene glycol dimethacrylate, vinylpyridine, vinyl acetate, methyl acrylate, vinylbenzyl chloride, vinylidene chloride, acrylic acid, divinylbenzene, acrylamidomethylpropanesulfonic acid, vinyltoluene, etc. Preferably, the crosslinked polymer is polystyrene or poly(methyl methacrylate). Most preferably, it is polystyrene and the cross-linking agent is divinylbenzene.

Processes well known in the art yield non-uniformly sized particles, characterized-by broad particle size distributions. The resulting beads can be classified by screening the produced beads over the range of the original distribution of sizes. Other processes such as suspension polymerization, limited coalescence, directly yield very uniformly sized particles.

The void-initiating materials may be coated with a slip agent to facilitate voiding. Suitable slip agents or lubricants include colloidal silica, colloidal alumina, and metal oxides such as tin oxide and aluminum oxide. The preferred slip agents are colloidal silica and alumina, most preferably, silica. The crosslinked polymer having a coating of slip agent may be prepared by procedures well known in the art. For example, conventional suspension polymerization processes wherein the slip agent is added to the suspension are preferred. As the slip agent, colloidal silica is preferred.

The void-initiating particles can also be inorganic spheres, including solid or hollow glass spheres, metal or ceramic beads or inorganic particles such as clay, talc, barium sulfate, calcium carbonate. The important thing is that the material does not chemically react with the core matrix polymer to cause one or more of the following problems: (a) alteration of the crystallization kinetics of the matrix polymer, making it difficult to orient, (b) destruction of the core matrix polymer, (c) destruction of the void-initiating particles, (d) adhesion of the void-initiating particles to the matrix polymer, or (e) generation of undesirable reaction products, such as toxic or highly colored moieties.

Suitable classes of thermoplastic polymers for the core matrix-polymer of the composite film include polyolefins, polyesters, polyamides, polycarbonates, cellulosic esters, polystyrene, polyvinyl resins, polysulfonamides, polyethers, polyimides, poly(vinylidene fluoride), polyurethanes, poly(phenylene sulfides), polytetrafluoroethylene, polyacetals, polysulfonates, polyester ionomers, and polyolefin ionomers. Copolymers and/or mixtures of these polymers can be used.

Suitable polyolefins include polypropylene, polyethylene, polymethylpentene, and mixtures thereof. Polyolefin copolymers, including copolymers of ethylene and propylene are also useful.

Suitable polyesters include those produced from aromatic, aliphatic or cycloaliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalenedicarboxylic acids, succinic, glutaric, adipic, azelaic, sebacic, fumaric, maleic, itaconic, 1,4-cyclohexanedicarboxylic, sodiosulfoisophthalic acids and mixtures thereof. Examples of suitable glycols include ethylene glycol, propylene glycol, butanediol, pentanediol, hexanediol, 1,4-cyclohexanedimethanol, diethylene glycol, other polyethylene glycols and mixtures thereof. Such polyesters are well known in the art and may be produced by well known techniques, e.g., those described in U.S. Pat. No. 2,465,319 and U.S. Pat. No. 2,901,466. Preferred continuous matrix polyesters are those having repeat units from terephthalic acid or naphthalenedicarboxylic acid and at least one glycol selected from ethylene glycol, 1,4-butanediol and 1,4-cyclohexanedimethanol. Poly(ethylene terephthalate), which may be modified by small amounts of other monomers, is especially preferred. Other suitable polyesters include liquid crystal copolyesters formed by the inclusion of suitable amounts of a co-acid component such as stilbenedicarboxylic acid. Examples of such liquid crystal copolyesters are those disclosed in U.S. Pat. Nos. 4,420,607, 4,459,402 and 4,468,510.

Useful polyamides include Nylon 6, Nylon 66, and mixtures thereof. Copolymers of polyamides are also suitable continuous phase polymers. An example of a useful polycarbonate is bisphenol-A polycarbonate. Cellulosic esters suitable for use as the continuous phase polymer of the composite films include cellulose nitrate, cellulose triacetate, cellulose diacetate, cellulose acetate propionate, cellulose acetate butyrate, and mixtures or copolymers thereof. Useful polyvinyl resins include poly(vinyl chloride), poly(vinyl acetal), and mixtures thereof. Copolymers of vinyl resins can also be utilized.

The nonvoided skin layers of the composite film can be made of the same polymeric materials as listed above for the core matrix. The composite film can be made with skin(s) of the same polymeric material as the core matrix, or it can be made with skin(s) of different polymeric composition than the core matrix. For compatibility, an auxiliary layer can be used to promote adhesion of the skin layer to the core.

Addenda may be added to the core matrix and/or to the skins to improve the whiteness of these films. This would include any process which is known in the art including adding a white pigment, such as titanium dioxide, barium sulfate, clay, or calcium carbonate. This would also include adding fluorescing agents which absorb energy in the UV region and emit light largely in the blue region, or other additives which would improve the physical properties of the film or the manufacturability of the film.

The coextrusion, quenching, orienting, and heat setting of these composite films may be effected by any process which is known in the art for producing oriented film, such as by a flat film process or a bubble or tubular process. The flat film process involves extruding the blend through a slit die and rapidly quenching the extruded web upon a chilled casting drum so that the core matrix polymer component of the film and the skin components(s) are quenched below their glass transition temperatures (Tg). The quenched film is then biaxially oriented by stretching in mutually perpendicular directions at a temperature above the glass transition temperature of the matrix and skin polymers. The film may be stretched in one direction and then in a second direction or may be simultaneously stretched in both directions. After the film has been stretched it is heat-set by heating to a temperature sufficient to crystallize the polymers while restraining to some degree the film against retraction in both directions of stretching.

These composite films may be coated or treated, after the coextrusion and orienting processes or between casting and full orientation, with any number of coatings which may be used to improve the properties of the films including printability, to provide a vapor barrier, to make them heat sealable, or to improve adhesion to the support or to the receiver layers. Examples of this would be acrylic coatings for printability, coating poly(vinylidene chloride) for heat seal properties, or corona discharge treatment to improve printability or adhesion.

By having at least one nonvoided skin on the microvoided core, the tensile strength of the film is increased and makes it more manufacturable. It allows the films to be made at wider widths and higher draw ratios than when films are made with all layers voided. Coextruding the layers further simplifies the manufacturing process.

It is preferable to extrusion laminate the microvoided composite films using a polyolefin resin onto the latex-impregnated paper support. During the lamination process, it is desirable to maintain minimal tension of the microvoided packaging film in order to minimize curl in the resulting laminated receiver support. The backside of the paper support (i.e., the side opposite to the microvoided composite film and receiver layer) may also be extrusion coated with a polyolefin resin layer (e.g., from about 10 to 75 g/m$^2$), and may also include a backing layer such as those disclosed in U.S. Pat. Nos. 5,011,814 and 5,096,875, the disclosures of which are incorporated by reference. For high humidity applications (>50% RH), it is desirable to provide a backside resin coverage of from about 30 to about 75 g/m$^2$, more preferably from 35 to 50 g/m$^2$, to keep curl to a minimum.

In one preferred embodiment, in order to produce receiver elements with a desirable photographic look and feel, it is preferable to use relatively thick paper supports (e.g., at least 120 μm thick, preferably from 120 to 250 μm thick) and relatively thin microvoided composite packaging films (e.g., less than 50 μm thick, preferably from 20 to 50 μm thick, more preferably from 30 to 50 μm thick).

The dye image-receiving layer of the receiving elements of the invention may comprise, for example, a polycarbonate, a polyurethane, a polyester, poly(vinyl chloride), poly(styrene-co-acrylonitrile), poly(caprolactone) or mixtures thereof. The dye image-receiving layer may be present in any amount which is effective for the intended purpose. In general, good results have been obtained at a concentration of from about 1 to about 10 g/m$^2$. An overcoat layer may be further coated over the dye-receiving layer, such as described in U.S. Pat. No. 4,775,657, the disclosure of which is incorporated by reference.

Dye-donor elements that are used with the dye-receiving element of the invention conventionally comprise a support having thereon a dye-containing layer. Any dye can be used in the dye-donor employed in the invention provided it is transferable to the dye-receiving layer by the action of heat. Especially good results have been obtained with sublimable dyes. Dye donors applicable for use in the present invention are described, e.g., in U.S. Pat. Nos. 4,916,112, 4,927,803 and 5,023,228, the disclosures of which are incorporated by reference.

As noted above, dye-donor elements are used to form a dye transfer image. Such a process comprises imagewise-heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of cyan, magenta and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2OO8-F3. Alternatively, other known sources of energy for thermal dye transfer may be used, such as lasers as described in, for example, GB No. 2,083,726A.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following example is provided to further illustrate the invention.

EXAMPLE

A. Dimensionally Stable Cellulosic Paper Cores

Dimensionally stable cellulosic paper core examples as well as controls are listed below. In this context, dimensional stability was rated by how much dimensional or size change a cellulosic paper sheet underwent when subjected to various moisture (humidity) conditions. It is generally known that the dimensional changes in paper with changes in moisture content are different along the machine and cross directions. The cross directional change is almost always greater (2:1 or more) than the machine directional change (Casey, J. P., *Pulp and Paper*, Vol. III, 1349–1358).

A pin gauge, utilizing a displacement digital indicator made by Ono Sokki Company, LTD Japan (Model EG-225), was used to measure dimensional changes (Humidity Size Change) for the cellulosic paper core samples and controls. Paper samples (25 mm×203 mm) were cut in both the machine direction and cross direction (3 replicates each). Holes 3 mm in diameter were then punched into the paper samples 178 mm apart. All of the paper samples were initially allowed to equilibrate at 50% RH and 23° C. for one week. Dimensional measurements were then made by placing the paper samples on the pin gauge (holes of the samples going over the pins on the pin gauge). The paper samples were then re-equilibrated at 20% RH and 23° C. for one week, dimensional measurements were made on the paper samples at this condition and the samples were re-equilibrated for one week at 70% RH and 23C. Dimensional measurements were again made. Lastly, the paper samples were re-equilibrated for one additional week at 20% RH and 23° C. and dimensional measurements were made.

The Humidity Size Change (% dimensional change between humidity conditions)=(Avg. dimension (mm)@previous condition–Avg. dimension (mm)@re-equilibrated condition)×100 divided by 178 mm.

The following cellulosic paper cores were evaluated.

Invention 1: Type S-60857 Munising LP clean room paper made by Kimberly-Clark Corporation, Roswell, Ga. 30076.

Invention 2: Type S-62891 Munising LP clean room paper made by Kimberly-Clark Corporation, Roswell, Ga. 30076.

Control 1: A paper stock support that was 137 μm thick and made from a 1:1 blend of Pontiac Maple 51 (a bleached maple hardwood kraft of 0.5 μm length weighted average fiber length) available from Consolidated Pontiac, Inc., and Alpha Hardwood Sulfite (a bleached red-alder hardwood sulfite of 0.69 μm average fiber length), available from Weyerhauser Paper Co.

Control 2: 89 μm thick "Rite in the Rain" All-Weather Writing Paper made by J.L. Darling Corporation, Tacoma, Wash. 98421.

Control 3: 127 μm thick "Rite in the Rain" All-Weather Writing Paper made by J.L. Darling Corporation, Tacoma, Wash. 98421.

The humidity size change values were measured and calculated as follows:

TABLE 1

| | Direction of Dimensional Change | % Humidity Size Change 50% to 20% RH* | % Humidity Size Change 20% to 70% RH* | % Humidity Size Change 70% to 20% RH* |
|---|---|---|---|---|
| Invention 1 | Machine | −0.07 | 0.14 | −0.14 |
| | Cross | −0.15 | 0.32 | −0.31 |
| Invention 2 | Machine | −0.07 | 0.10 | −0.12 |
| | Cross | −0.17 | 0.37 | −0.35 |
| Control 1 | Machine | −0.19 | 0.28 | −0.32 |
| | Cross | −0.32 | 0.61 | −0.57 |
| Control 2 | Machine | −0.12 | 0.13 | −0.20 |
| | Cross | −0.30 | 0.51 | −0.53 |
| Control 3 | Machine | −0.12 | 0.14 | −0.19 |
| | Cross | −0.29 | 0.49 | −0.52 |

*Positive values represent expansion, negative values represent shrinkage

The above results show that the invention supports have much less dimensional change, especially in the cross direction, when subjected to different humidity levels as compared to the prior art control supports.

B. Preparation of the Microvoided Support

Receiver support samples were prepared in the following manner. A commercially available packaging film (OPPalyte® 350 TWK made by Mobil Chemical Co.) was laminated to the paper stocks described above. OPPalyte® 350 TWK is a composite film (36 μm thick) (d=0.62) consisting of a microvoided and oriented polypropylene core (approximately 73% of the total film thickness), with a titanium dioxide pigmented non-microvoided oriented polypropylene layer on each side; the void-initiating material is poly(butylene terphthalate). Reference is made to U.S. Pat. No. 5,244,861 where details for the production of this laminate are described.

Packaging films may be laminated in a variety of ways (by extrusion, pressure, or other means) to a paper support. In the present context, they were extrusion laminated as described below with pigmented polyolefin onto a paper stock support. The pigmented polyolefin was polyethylene (12 g/m$^2$) containing anatase titanium dioxide (12.5% by weight) and a benzoxazole optical brightener (0.05% by weight). The backside of the paper stock support was coated with high density polyethylene (30 g/m$^2$).

C. Preparation of Thermal Dye Transfer Receiving Elements

Thermal dye-transfer receiving elements were prepared from the above receiver supports by coating the following layers in order on the top surface of the microvoided packaging film:

a) a subbing layer of Prosil® 221 and Prosil® 2210(PCR, Inc.)(1:1 weight ratio) both are amino-functional organo-oxysilanes, in an ethanol-methanol-water solvent mixture. The resultant solution (0.10 g/m$^2$) contained approximately 1% of silane component, 1% water, and 98% of 3A alcohol;

b) a dye-receiving layer containing Makrolon® KL3-1013 (a polyether-modified bisphenol-A polycarbonate block copolymer) (Bayer AG) (1.82 g/m$^2$), GE Lexan® 141-112 (a bisphenol-A polycarbonate) (General Electric Co.) (1.49 g/m$^2$), and Fluorad® FC-431 (perfluorinated alkylsulfonamidoalkyl ester surfactant) (3M Co.) (0.011 g/m$^2$), di-n-butyl phthalate (0.33 g/m$^2$), and diphenyl phthalate (0.33 g/m$^2$) and coated from a solvent mixture of methylene chloride and trichloroethylene (4:1 by weight) (4.1% solids);

c) a dye-receiver overcoat containing a solvent mixture of methylene chloride and trichloroethylene; a polycarbonate random terpolymer of bisphenol-A (50 mole %), diethylene glycol (93.5 wt %) and polydimethylsiloxane (6.5 wt. %) 2500 MW) block units (50% mole %) (0.65 g/m$^2$) and surfactants DC-510 Silicone Fluid (Dow-Corning Corp.) (0.008 g/m$^2$), and Fluorad® FC-431 (3M Co.) (0.016 g/m$^2$) from dichloromethane.

D. Curl Measurements on Test Samples

Test samples were conditioned for one week at both 5% RH/23° C. and 85% RH/23° C., after which curl measurements were made. The test samples were 21.6 cm×27.9 cm in size (27.9 cm in the machine direction).

After conditioning, the samples were placed on a flat surface with the curled edges pointing away from the flat surface. Using a ruler, the height (measured to the nearest 0.16 cm) of each corner above the flat surface was measured. The four heights were averaged together to give a single edge rise curl value. A positive curl value indicates curl toward the face or dye-receiving layer side. A negative curl value indicates curl toward the back side. For comparison purposes, the curl difference between 85% RH/23° C. and 5% RH/23° C. is given to represent total curl performance (smaller differences mean lower cud over this range). This curl method is based on TAPPI Test Method T 520 cm-85. The following results were obtained:

TABLE 2

| | Edge Rise Curl At 5% RH, 73 F. (mm) | Edge Rise Curl At 85% RH, 73 F. (mm) | Curl Difference 85% RH – 5% RH (mm) |
|---|---|---|---|
| Invention 1 | 3.6 | 11.7 | 8.1 |
| Invention 2 | 8.7 | 10.1 | 1.4 |
| Control 1 | −45.8 | 25.6 | 71.4 |
| Control 2 | −33.5 | 36.5 | 70.0 |
| Control 3 | −21.8 | 45.4 | 67.2 |

The above results show that the thermal dye transfer receiving elements made with the supports of the invention have significantly lower curl values over a wide range of environmental conditions than the control prior art supports.

E. Thermal Printing for Image Uniformity and Density

To measure image uniformity and print density on the test samples, a magenta test image of non-graduated density was printed on each. Magenta dye containing thermal dye transfer donor elements were prepared by coating on 6 μm poly(ethylene terephthalate) support:

a) a subbing layer of Tyzor® TBT (a titanium tetra-n-butoxide)(DuPont Co.) (0.12 g/m$^2$) from 1-butanol; and b) a dye-layer containing the magenta dyes illustrated below (M-1 at 0.12 g/m$^2$ and M-2 at 0.13 g/m$^2$) and S-363 (Shamrock Technologies, Inc.) (a micronized blend of polyolefin and oxidized polyolefin particles) (0.016 g/m$^2$), in a cellulose acetate propionate binder (2.5% acetyl, 45% propionyl) (0.40 g/m$^2$) from a toluene, methanol, and cyclopentanone solvent mixture.

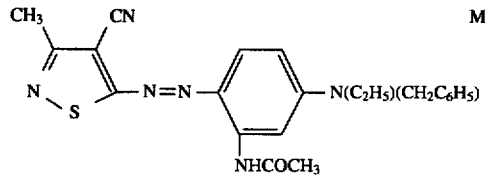

Magenta Dye 1

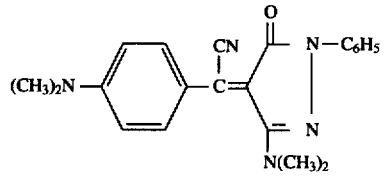

Magenta Dye2

On the backside of the dye donor element was coated:

a) a subbing layer of Tyzor® TBT (0.12 g/m$^2$) from 1-butanol; and b) a slipping layer of Emralon® 329 (a dry film lubricant of poly(tetrafluoroethylene) particles) (Acheson Colloids Co.) (0.59 g/m$^2$); BYK-320 (a polyoxyalkylene-emethyl alkyl siloxane copolymer) (BYK Chemie USA) (0.006 g/m$^2$); PS-513 (an aminopropyl-terminated polydimethylsiloxane) (Petrarch Systems, Inc.) (0.006/gm$^2$); S-232 (a micronized blend of polyethylene and carnauba wax particles) (Shamrock Technologies, Inc.) (0.016 g/m$^2$) coated from a toluene, n-propyl acetate, 2-propanol and 1-butanol solvent mixture.

To evaluate relative printing efficiency and uniformity using a thermal head, the dye-donors were printed at constant energy to provide a mid-scale test image on each dye-receiver element. The imaged prints were prepared by placing the dye-donor element in contact with the polymeric receiving layer side of the receiver element. The assemblage was fastened to the top of a motor driven 56 mm diameter rubber roller and a TDK Thermal Head L-231, thermostated at 26° C. with a head load of 3.6 Kg pressed against the rubber roller. (The TDK L-23 1 thermal print head had 512 independently addressable heaters with a resolution of 5.4 dots/mm and an active printing width of 95 mm, of average heater resistance 512 Ω). The imaging electronics were activated and the assemblage was drawn between the printing head and roller at 20.6 mm/sec. coincidentally, the resistive elements in the thermal print head were pulsed on for 128 μs every 130 μs. The voltage supplied to the print head was approximately 21.50 v with a line time of 17 μs.

Printing efficiency was evaluated by measuring the printed (magenta) density using an X-Rite® Sensitometer (X-Rite Corp., Grandville, Mich.) with Status A filters. The green density values for the receiver elements were measured as follows:

TABLE 3

| | GREEN DENSITY |
|---|---|
| Invention 1 | 0.40 |
| Invention 2 | 0.41 |
| Control 1 | 0.41 |
| Control 2 | 0.41 |
| Control 3 | 0.41 |

The above results show that all five receiver elements yield good densities when printed under these conditions. Thus, the invention supports have equivalent printing properties as the control supports and show no density degradation.

The invention has been described in detail with particular reference to preferred embodiments thereof, but it will be understood that variations and modifications can be effected within the spirit and scope of the invention.

What is claimed is:

1. A dye-receiving element for thermal dye transfer comprising a support having thereon in order, a composite film laminated thereto, and a dye image-receiving layer, said composite film comprising a microvoided thermoplastic core layer and at least one substantially void-free thermoplastic surface layer having a thickness of about 3 to about 6 μm, and wherein said support comprises a latex-impregnated paper containing about 18 to 40 parts impregnated latex per 100 parts fiber by weight.

2. The element of claim 1 wherein said impregnating latex is a polyacrylate, a styrene-butadiene copolymer, an ethylene-vinylacetate copolymer, a nitrile rubber, poly(vinyl chloride), poly(vinyl acetate) or an ethylene-acrylate copolymer.

3. The element of claim 1 wherein said impregnating latex is a reactive acrylic polymer latex.

4. The element of claim 1 wherein said latex impregnated paper has a basis weight of about 58 g/m$^2$ on a dry weight basis.

5. The element of claim 1 wherein the thickness of said composite film is from 30 to 70 μm.

6. The element of claim 1 wherein said core layer of said composite film comprises from 30 to 85% of the thickness of said composite film.

7. The element of claim 1 wherein said microvoided thermoplastic core layer has a substantially void-free thermoplastic surface layer on each side thereof.

8. The element of claim 1 wherein said microvoided thermoplastic core layer comprises oriented polypropylene and said substantially void-free thermoplastic surface layer comprises oriented polypropylene on each side thereof.

9. The element of claim 8 further comprising a polyolefin backing layer on the side of said support opposite to said composite film.

10. A process of forming a dye transfer image comprising:

a) imagewise-heating a dye-donor element comprising a support having thereon a dye layer comprising a dye dispersed in a binder, and b) transferring a dye image to a dye-receiving element comprising a support having thereon a dye image-receiving layer to form said dye transfer image, wherein said dye-receiving element comprises a support having thereon in order, a composite film laminated thereto, and a dye image-receiving layer, said composite film comprising a microvoided thermoplastic core layer and at least one substantially void-free thermoplastic surface layer having a thickness of about 3 to about 6 μm, and wherein said support comprises a latex-impregnated paper containing about 18 to 40 parts impregnated latex per 100 parts fiber by weight.

11. The process of claim 10 wherein said impregnating latex is a polyacrylate, a styrene-butadiene copolymer, an ethylene-vinylacetate copolymer, a nitrile rubber, poly(vinyl chloride), poly(vinyl acetate) or an ethylene-acrylate copolymer.

12. The process of claim 10 wherein said impregnating latex is a reactive acrylic polymer latex.

13. The process of claim 10 wherein said latex impregnated paper has a basis weight of about 58 g/m$^2$ on a dry weight basis.

14. A thermal dye transfer assemblage comprising:

a) a dye-donor element comprising a support having thereon a dye layer comprising a dye dispersed in a binder, and b) a dye-receiving element comprising a support having thereon a dye image-receiving layer, said dye-receiving element being in a superposed relationship with said dye-donor element so that said dye layer is in contact with said dye image-receiving layer, wherein said dye-receiving element comprises a support having thereon in order, a composite film laminated thereto, and a dye image-receiving layer, said composite film comprising a microvoided thermoplastic core layer and at least one substantially void-free thermoplastic surface layer having a thickness of about 3 to about 6 μm, and wherein said support comprises a latex-impregnated paper containing about 18 to 40 parts impregnated latex per 100 parts fiber by weight.

15. The assemblage of claim 14 wherein said latex is a polyacrylate, a styrene-butadiene copolymer, an ethylene-vinylacetate copolymer, a nitrile rubber, poly(vinyl chloride), poly(vinyl acetate) or an ethylene-acrylate copolymer.

16. The assemblage of claim 14 wherein said impregnating latex is a reactive acrylic polymer latex.

17. The assemblage of claim 14 wherein said latex impregnated paper has a basis weight of about 58 g/m$^2$ on a dry weight basis.

* * * * *